US006360700B1

(12) United States Patent
Kern

(10) Patent No.: US 6,360,700 B1
(45) Date of Patent: Mar. 26, 2002

(54) REFRACTORY LINING FOR TUBULAR WALL

(75) Inventor: Andreas Kern, Basel (CH)

(73) Assignee: Mokesys AG, Birsfelden (CH)

( * ) Notice: Subject to any disclaimer, the term of this patent is extended or adjusted under 35 U.S.C. 154(b) by 0 days.

(21) Appl. No.: 09/530,455

(22) PCT Filed: Oct. 22, 1998

(86) PCT No.: PCT/CH98/00453

§ 371 Date: Apr. 28, 2000

§ 102(e) Date: Apr. 28, 2000

(87) PCT Pub. No.: WO99/26023

PCT Pub. Date: May 27, 1999

(30) Foreign Application Priority Data

Nov. 18, 1997 (CH) ..... 2672/97

(51) Int. Cl.[7] ..... F22B 17/02

(52) U.S. Cl. ..... 122/511; 122/512; 122/DIG. 13; 110/325

(58) Field of Search ..... 122/DIG. 13, 510, 122/511, 512; 110/325

(56) References Cited

U.S. PATENT DOCUMENTS

| | | | | |
|---|---|---|---|---|
| 1,710,901 A | | 4/1929 | Schroeder | |
| 2,879,660 A | | 3/1959 | Reintjes | |
| 3,850,146 A | | 11/1974 | Graham et al. | |
| 4,809,621 A | * | 3/1989 | Materna | 110/325 |
| 5,154,139 A | * | 10/1992 | Johnson | 122/510 |
| 5,423,294 A | * | 6/1995 | Cole et al. | 122/512 |
| 5,542,378 A | * | 8/1996 | Kubiak et al. | 122/511 |
| 5,845,610 A | * | 12/1998 | Hatta et al. | 122/511 |
| 6,012,401 A | * | 1/2000 | Orita et al. | 122/510 |

FOREIGN PATENT DOCUMENTS

| | | |
|---|---|---|
| DE | 548078 | 4/1932 |
| DE | 3315199 | 1/1985 |
| DE | 8908821 | 10/1989 |
| DE | 3817188 | 11/1989 |
| DE | 29701591 | 3/1997 |
| EP | 0656508 | 6/1995 |

* cited by examiner

*Primary Examiner*—Gregory Wilson
(74) *Attorney, Agent, or Firm*—Selitto, Behr & Kim

(57) ABSTRACT

A refractory tube wall lining comprises a multiplicity of refractory tiles (1) which are arranged next to and above one another and each have two T-shaped slots (16) which extend over the entire height of the tile. The tiles (1) are held on the lined tube wall (2) by means of in each case two screw-like tile holders (11). Brackets which are independent of the tile holders (11) are used to support the tiles (1). Stepped top and bottom edges of the tiles (1) allow the tiles (1) to move vertically with respect to one another without the seal of the tube wall lining being lost. For the same purpose, the two side edges (14, 15) of each tile (1) are fitted with a tongue (141) or a groove (151).

18 Claims, 3 Drawing Sheets

REFRACTORY LINING FOR TUBULAR WALL

FIELD OF THE INVENTION

The present invention relates to a refractory tube wall lining having a multiplicity of refractory tiles which are arranged next to and above one another.

BACKGROUND OF THE INVENTION

Refractory tube wall linings are used, for example, to protect tube walls in furnaces of refuse incineration plants from corrosion caused by flue gases. In modern refuse incineration plants, the tube walls and tube wall linings are often exposed to temperatures of over 1000° C. and, also if suitable materials are selected, undergo expansion and contraction owing to the considerable differences in temperature between the individual operating states. The temperature differences are generally greater at the tube wall linings than at the tube walls, and this has to be taken into account when selecting the material and/or design of the tube wall linings, so that the tube wall linings are not destroyed by greater expansions and contractions than the tube walls.

The selection of a suitable material for the tube wall lining enables the tube wall lining to be adapted to the tube wall for each operating state. For tube walls made from steel, SiC tube wall linings have proven suitable, in which linings the SiC content may vary considerably. In practice, SiC mixtures or SiC tiles with an SiC content of 30%–90% are used.

Various refractory tube wall linings are known which comprise a multiplicity of refractory ceramic SiC tiles which are arranged next to and above one another and are each attached by means of at least one tile holder to the tube wall to be protected. The SiC content of the ceramic tiles varies; however, the use of so-called SiC 90 tiles, i.e. tiles with an SiC content of approx. 90%, is widespread.

In the tube wall tile system JUSYS RWS 4.2 produced by Jünger+Gräter GmbH, Schwandorf, Germany, each tile is, firstly, supported and retained in the wall direction by a pin which is welded to the tube wall and, secondly, is bonded to the tube wall by means of an SiC mortar.

In the tube wall tile system Carborundum produced by Saint-Gobain Industriekeramik GmbH, Cologne, Germany, each tile is hung from a pin-like tile holder which runs obliquely upward from the tube wall.

EP-A-0 656 508 has disclosed a refractory tube wall lining in which the tiles are attached to webs of the tube wall between the tubes by means of screws. These screws are in this case responsible for both a supporting function and a holding function.

One problem which arises with these tile systems is the susceptibility of the tube wall lining to damage if the refuse incineration plant is run up too quickly, since tube wall lining and tube wall are heated at different rates. Since the freedom of an individual tile to move is limited by the tile holder and the adjoining tiles, the more rapid expansion of the tile compared to that of the tube wall in the event of the plant being run up too quickly cannot be compensated for, and the tile and/or adjacent tiles is or are broken off or detached.

DE-U-89 08 821 has described a tube wall lining in which lining bricks are supported and held by brackets and holders, respectively. The brackets and holders are arranged directly on the tubes, which in certain countries requires inspection by an expert.

U.S. Pat. No. 3,850,146 has disclosed a refractory tube wall lining in which a multiplicity of refractory tiles arranged next to and above one another are held on a tube wall with tubes which are connected by webs by means of tile holders, the tile holders not having any supporting function. A plurality of tiles arranged above one another are supported by brackets which are welded to the tubes. The tile holders are attached on the tube wall side by means of the brackets.

The fact that the tile holders do not have any supporting function means that they can hold the tiles on the tube wall in a vertically displaceable manner. However, a problem of this tube wall lining is that the brackets have to be welded to the pipes, i.e. to the pressure bodies. In many countries, welds on the pressure body have to be checked by a recognized expert or a designated authority. Also subsequent changes are relatively complex for this reason.

SUMMARY OF THE INVENTION

In view of the drawbacks of the known tube wall tile systems, the present invention is based on the object of providing a refractory tube wall lining having a multiplicity of refractory tiles which are arranged next to and above one another and where different expansions and contractions of the refractory tiles and the lined tube wall can be absorbed in both the vertical and the horizontal direction without damage to the tube wall lining and which can be fitted without welding on the tubes.

This object is achieved by means of the refractory tube wall lining according to the present invention. An alternative embodiment of the present invention includes a wall which has been provided with a refractory lining according to the present invention. Another embodiment relates to a method for refractory lining of a tube wall. Additional alternative embodiments and modifications of the present invention are also disclosed.

The essence of the present invention consists in the fact that, in a refractory tube wall lining having a multiplicity of refractory tiles which are arranged next to and above one another and each have at least one tile holder, which is or are intended to hold the tile on a tube wall which comprises tubes connected by webs, the tile holders having no supporting function, and the tiles being supported by at least one bracket which is independent of the tile holders, the tile holders and the bracket or brackets are designed to be attached to the webs of the tube wall.

The fact that the tube wall lining is attached to the webs and not to the tubes means that the pressure body is not impaired. Therefore, there is no need for checks by a recognized expert or a designated authority. A further advantage is that the tile holders and the brackets are cooled through their connection to the webs. Moreover, since the tiles are not rigidly attached to the tube wall, if the tiles are arranged suitably spaced apart, expansions and contractions of the tiles can be absorbed through displacement in the vertical and horizontal directions.

In a preferred embodiment, a plurality of tiles which are arranged above one another are supported, directly or via the tile or tiles arranged below them, by a single bracket which, when the tube wall lining is mounted on a tube wall, is attached, by welding to the tube wall. The tiles supported by the bracket can then expand and move upward. The tile mobility which is increased in this way compared to the prior art enables greater expansions and contractions of the tube wall lining to be absorbed without damage than is the case with known tube wall tile systems.

BRIEF DESCRIPTION OF THE DRAWINGS

For a better understanding of the present invention, reference is made to following detailed description of several preferred embodiments, considered in conjunction with the accompanying drawings, in which.

DESCRIPTION OF THE PREFERRED EMBODIMENTS

FIG. 1

Figure 1:
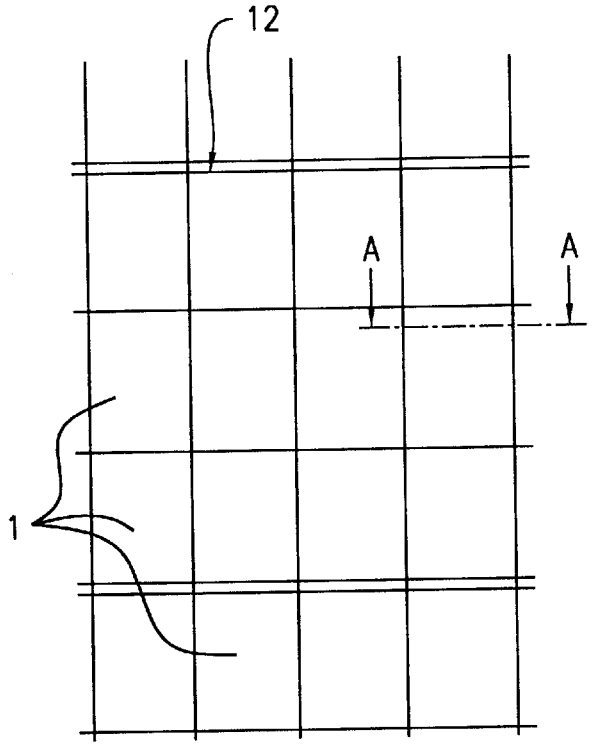
FIG. 1 diagrammatically depicts a front view of a tube wall lining according to the invention, having a multiplicity of refractory tiles arranged next to and above one another.

A refractory tube wall lining according to the invention comprises a multiplicity of refractory tiles 1 which are arranged next to and above one another. The tiles are, for example, ceramic SiC tiles, preferably SiC 90 tiles, which are fireproof to over 1000° C. Each tile 1 is held on the lined tube wall by two tile holders which cannot be seen here and do not have any supporting function. In each case three tiles 1 arranged one above the other are supported by a bracket, which likewise cannot be seen in this figure. The bottom edges of these tiles 1 rest on the bracket or on the top edge of the tile 1 arranged beneath them. Between the top edge 12 of the top of the three tiles 1 and the bracket for the higher tiles 1 located above it, there is space left clear for tiles to expand and move in the vertical direction.

The following statement applies to the whole of the rest of the description. If reference numerals are given in a figure in order to make the drawing clearer but are not explained in the directly corresponding text of the description, reference is made to where they have been mentioned in the description of previous figures.

Figure 2:
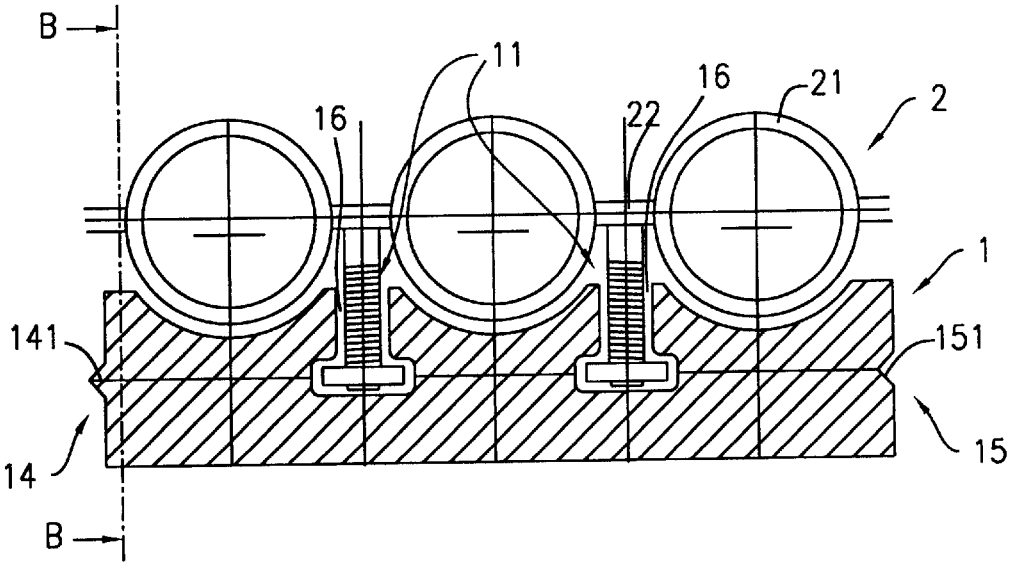
FIG. 2 shows a sectional view of a refractory tile arranged on a tube wall by means of two tile holders, on line A—A in FIG. 1.
Figure 3:
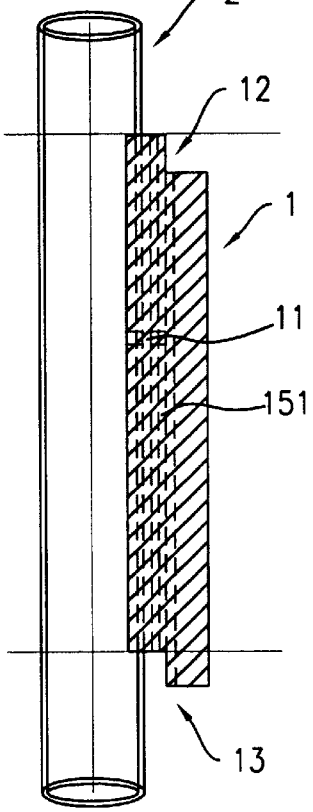
FIG. 3 shows a sectional view of the refractory tile arranged on the tube wall, on line B—B in FIG. 2.

FIGS. 2 and 3

The lined tube wall 2 is in this case a tube wall with vertical tubes 21 which are connected by webs 22. Two tile holders 11, in the form of screws, which belong to the tube wall lining, are mounted on the webs 22, in particular by being shot on using a pistol. The refractory tile 1 has two T-shaped slots 16 which extend from the top edge 12 to the bottom edge 13, and the tile can be moved over the tile holders 11 from above. The rear side of the tile 1, which faces the tube wall, is provided with three recesses which are in the form of a segment of a cylinder and extend over the entire height, so that the tile 1 is at a uniform distance from the tube wall over wide areas. Ideally, this distance is approximately 5 mm. It can be set by adjustment of the tile holders 11 before the tile 1 is moved over them. If necessary, the tile 1 has to be removed again and the tile holders 11 have to be readjusted.

The top edge 12 and the bottom edge 13 of the tile 1 have complementary steps over the thickness of the tile. If two such tiles 1 are arranged one above the other, the partially overlapping edges ensure that the tiles can be moved toward and away from one another to a certain extent without a gap which allows gas to flow through in a straight line being formed between the two tiles.

The side edge 14 of the tile 1 has a tongue 141, and the side edge 15 has a complementary groove 151, which, when two such tiles 1 are arranged next to one another, ensures that the tiles can be moved toward and away from one another to a certain extent without a gap which allows gas to flow through in a straight line being formed between the two tiles.

Naturally, the top edge 12 and the bottom edge 13 may also be provided with a tongue and groove, or the side edges 14 and 15 may have complementary steps. Other edge shapes, for example curved shapes, are also conceivable, provided that they prevent gas from flowing through in a straight line between two tiles which are arranged next to or above one another for all the relative positions which occur in practice.

A refractory ceramic fiber strip which seals the gaps between the tiles 1 is arranged in each case between the facing edges 12 and 13 or 14 and 15 of two tiles 1 arranged next to or above one another, so that it is impossible for any flue gas to pass through the tube wall lining to the tube wall 2. Refractory ceramic fiber strips which are able to withstand temperatures of up to 1350° C. are commercially available.

The space between the tube wall 2 and the tile 1 is filled with SiC liquid mortar (not shown here) which additionally bonds the tile 1 to the tube wall 2. If the tile 1 is moved, cracks form in the mortar or the mortar becomes detached from the tube wall 2 or the tile 1. However, this does not have any adverse effects on the seal of the tube wall lining, since this is ensured by the tiles 1 and the ceramic fiber strips.

After the tiles 1 have been positioned at the correct distance from the tube wall 2, the SiC mortar is allowed to enter from above between the tiles 1 and the tube wall 2 as liquid mortar and also flows into the slots 16. To ensure the mobility of the tiles 1, the tile holders 11 are therefore previously surrounded by a refractory foam which remains elastic.

The SiC liquid mortar preferably has an SiC content of between 30% and 90%, in particular between 40% and 60%, and a porosity of less than 20%, in particular between 13% and 17%. An SiC liquid mortar which contains 58% SiC, 13% $SiO_2$, 26% $Al_2O_3$, 0.2% $Fe_2O_3$ and 1.5% CaO has proven particularly suitable.

The tile holders 11 themselves are made from heat-resistant steel, e.g. steel no. 310 in accordance with AISI standard or material no. 1.4845 in accordance with DIN 17440.

Figure 4:
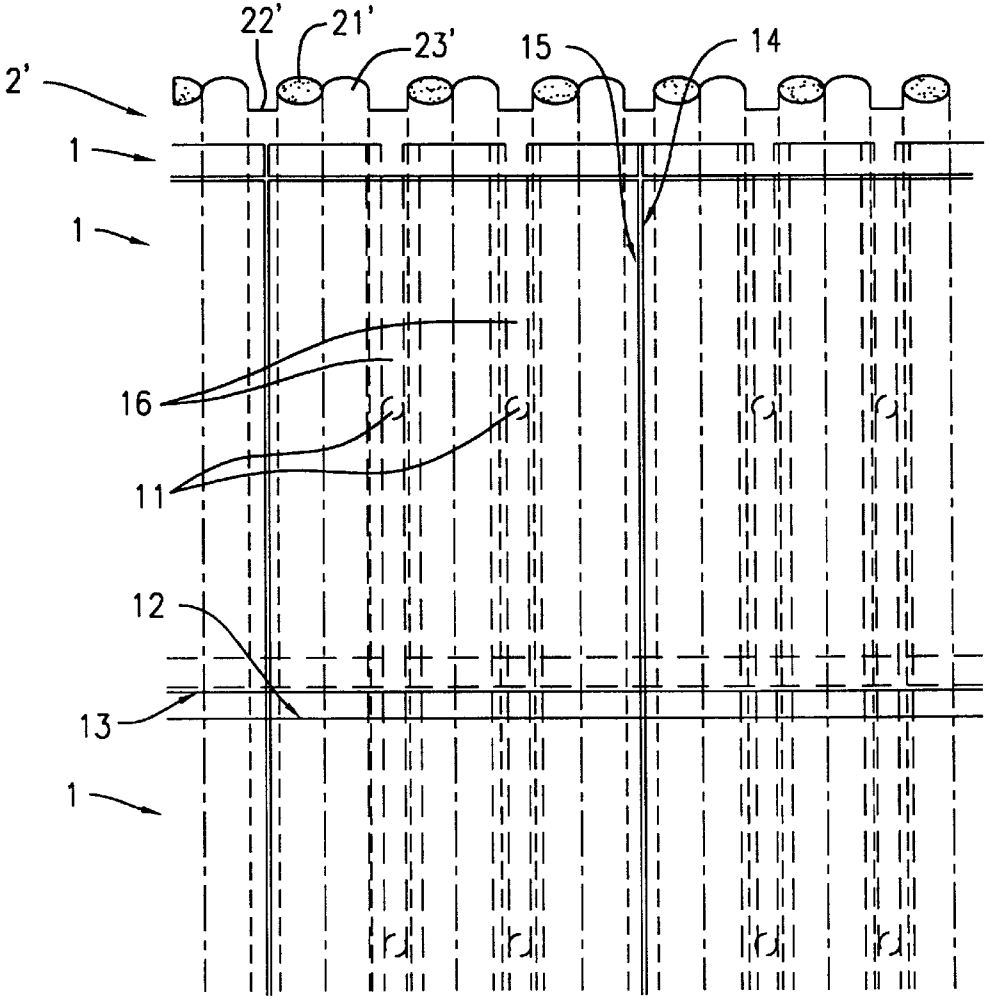
FIG. 4 shows a front view of part of the tube wall lining from FIG. 1 arranged on a tube wall.
Figure 6:
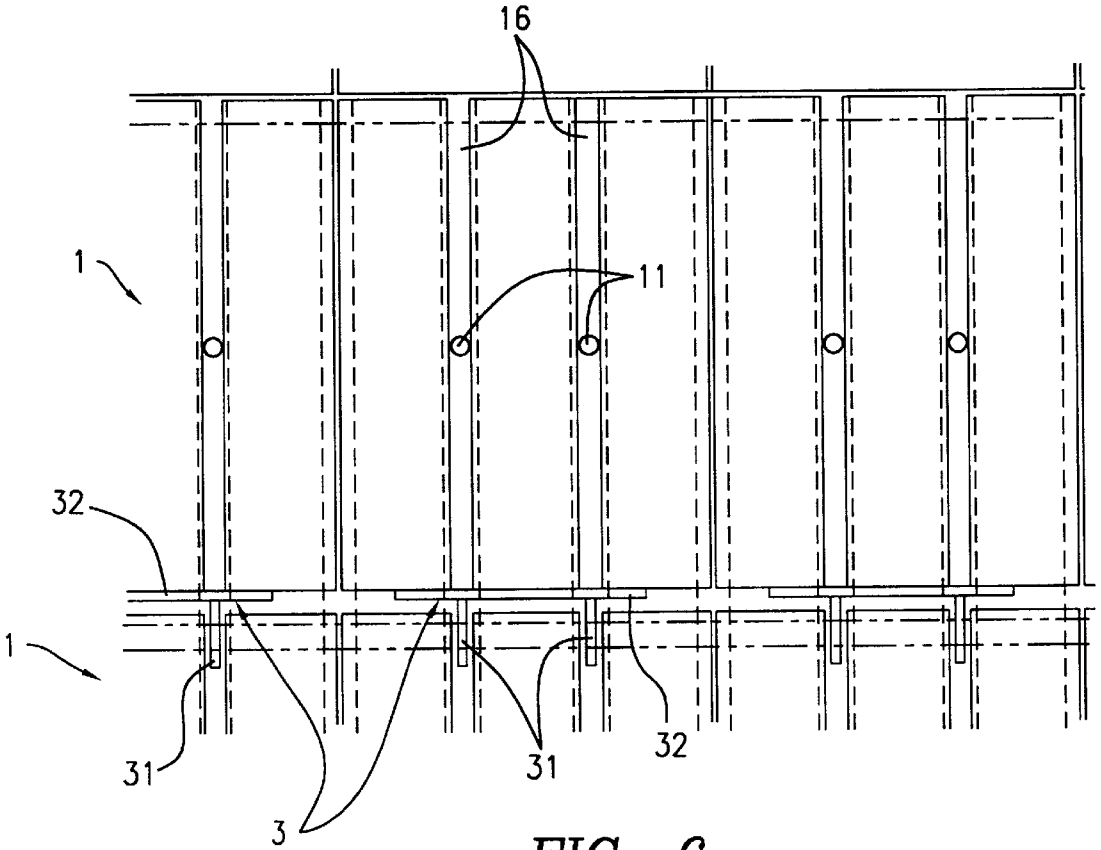
FIG. 6 shows a rear view of the tube wall lining part from FIG. 4.
Figure 5:
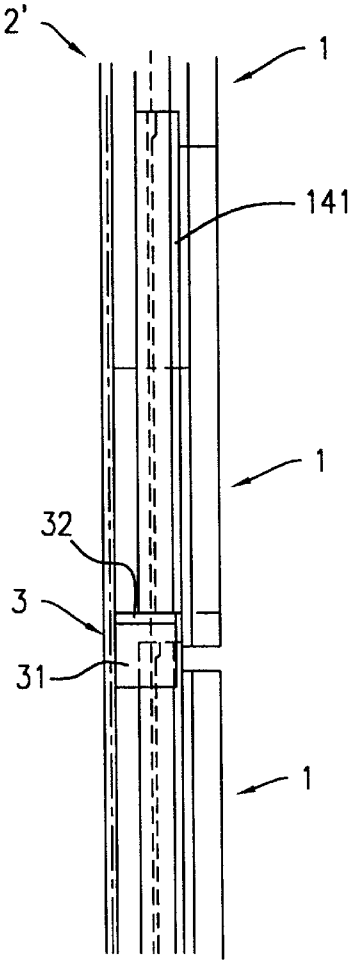
FIG. 5 shows a side view of the tube wall lining part and tube wall part from FIG. 4.

FIGS. 4 to 6

The tube wall lining is in these figures arranged on a tube wall 2', in which a web 22' is arranged in each case next to two adjoining tubes 21' and 23'. Advantageously, the tiles 1 have correspondingly adapted rear sides with recesses in the shape of a partial cylinder.

To support the tiles 1, brackets 3 are welded to the tube wall 2'. The brackets 3 in each case comprise two vertically arranged support plates 31 which are each welded to a web 22', and a horizontally arranged bearing plate 32, which is welded to the two support plates 31. Support plates 31 and bearing plates 32 are made from heat-resistant steel, e.g. steel no. 310 in accordance with AISI standard or material no. 1.4845 in accordance with DIN 17440.

Each bracket 3 supports a tile 1 which rests directly on the bearing plate 32 and, indirectly, the tiles 1 arranged between this tile 1 and the next bracket 3 in the vertical direction, the bottom edges 13 of which in each case rest on the top edge 12 of the tile 1 lying below them.

Due to the stepped formation, there are two gaps between the bottom, stepped edge 13 of a tile 1 resting directly on a bracket 3 and the top, stepped edge 12 of the tile 1 positioned beneath it, which gaps provide the bottom tile 1 with a freedom to move but are not in direct contact with one another, so that the tube wall lining is sealed in all the relative tile positions which occur in operation.

The tile holders 11 are only diagrammatically indicated, rather than being drawn in full, in FIGS. 4 to 6.

Further design variations are possible in relation to the tube wall linings described above. It should also be expressly mentioned here that the slots 16 do not necessarily have to be T-shaped. Other shapes, such as for example part of a cylinder, are also conceivable. The only important factor is that there be a narrower region between a wider region in the tile interior and the rear-side tile edge, so that the tiles 1 can be held on the tube wall 2 by means of the tile holders 11.

What is claimed is:

1. A refractory tube wall lining comprising a plurality of refractory tiles (1) which are arranged next to and above one another; at least one tile holder (11), which is intended to hold each tile (1) on a tube wall (2; 2') having tubes (21; 21'; 23') connected by webs (22; 22'), said at least one tile holder (11) permitting displacement of said tile (1) parallel to said tube wall (2; 2'), and said plurality of refractory tiles (1) being supported by at least one bracket (3) which is independent of said at least one tile holder (11), wherein said at least one tile holder (11) and said at least one bracket (3) are designed to be attached to the webs (22; 22') of the tube wall (2; 2').

2. The refractory tube wall lining according to claim 1, wherein said at least one tile holder (11) and said at least one bracket (3) are designed to be welded to the webs (22; 22') of the tube wall (2; 2').

3. The refractory tube wall lining according to claim 2, wherein each of said plurality of refractory tiles (1) has a thickness, a top edge (12) and a bottom edge (13), said top edge (12) and said bottom edge (13) having complementary steps over said thickness and, when arranged one above the other, each of said plurality of refractory tiles (1) can be moved toward and away from one another over a range of movement without creating a separation through which gas can flow in a straight line from a side of the tube wall lining which is remote from the tube wall (2; 2') to said at least one bracket (3).

4. The refractory tube wall lining according to claim 1, wherein a plurality of refractory tiles (1) are arranged one above the other and are supported by a single bracket (3).

5. The refractory tube wall lining according to claim 4, wherein each of said plurality of refractory tiles (1) has a thickness, a top edge (12) and a bottom edge (13), said top edge (12) and said bottom edge (13) having complementary steps over said thickness and, when arranged one above the other, each of said plurality of refractory tiles (1) can be moved toward and away from one another over a range of movement without creating a separation through which gas can flow in a straight line from a side of the tube wall lining which is remote from the tube wall (2; 2') to said at least one bracket (3).

6. The refractory tube wall lining according to claim 1, wherein each of said plurality of refractory tiles (1) has a thickness, a top edge (12) and a bottom edge (13), the top and bottom edges (12,13) of adjacent tiles being designed in such a way over said thickness that when arranged one above the other, each of said plurality of refractory tiles (1) can be moved toward and away from one another over a range of movement without creating a separation through which gas can flow in a straight line.

7. The refractory tube wall lining according to claim 1, wherein each of said plurality of refractory tiles (1) has one side edge (14) that cooperates with another side edge (15) of an adjacent one of said plurality of refractory tiles (1) such that said two tiles (1) can be moved toward and away from one another to a certain extent without there being a gap therebetween which would allow gas to flow through in a straight line.

8. The tube wall lining according to claim 1, wherein a refractory ceramic fiber strip is arranged in between each of said plurality of refractory tiles (1) that are arranged adjacent to one another.

9. The refractory tube wall lining according to claim 1, wherein at least one of said plurality of refractory tiles (1) includes a rear side which faces the tube wall (2; 2') when said tube wall lining is mounted on said tube wall (2; 2') and has at least one slot (16), which extends over at least a portion of the height of said at least one of said plurality of refractory tiles (1), said at least one slot (16) being sized and shaped to receive at least a portion of said at least one tile holder (11) which is provided with a widened section, so that said at least one tile holder retains said plurality of refractory tiles (1) on the wall but allows vertical displacement of said plurality of refractory tiles (1).

10. The refractory tube wall lining according to claim 9, wherein said at least one tile holder (11) is surrounded within said at least one slot (16) by elastic refractory foam.

11. The refractory tube wall lining according to claim 9, wherein said at least one tile holder (11) is a screw.

12. A method for lining a tube wall (2; 2'), having tubes (21; 21'; 23') which are connected by webs (22; 22'), with a tube wall lining according to any one of claims 1 to 8 and 12 to 16, comprising attaching the brackets (3) and the tile holders (11) to the webs (22; 22') of the tube wall (2; 2'), then positioning the plurality of refractory tiles (1) at a distance from the tube wall (2; 2'), and filing the space between the tube wall (2; 2') and the tiles (1) with liquid mortar.

13. The refractory tube wall lining according to claim 1, wherein each of said plurality of refractory tiles (1) has a thickness, a top edge (12) and a bottom edge (13), said top edge (12) and said bottom edge (13) having complementary steps over said thickness and, when arranged one above the other, each of said plurality of refractory tiles (1) can be moved toward and away from one another over a range of movement without creating a separation through which gas can flow in a straight line from a side of the tube wall lining which is remote from the tube wall (2; 2') to said at least one bracket (3).

14. The refractory tube wall lining according to claim 1, wherein each of said plurality of refractory tiles (1) has one side edge (14) with a tongue (141) and another side edge (15) having a groove (151) that cooperates with the tongue (141) of said another side edge (15) of an adjacent one of said plurality of refractory tiles (1) such that said two tiles (1) can be moved toward and away from one another to a certain extent without there being a gap therebetween which would allow gas to flow through in a straight line.

15. A fire-proof barrier, comprising:

a wall structure having tubes (21; 21'; 23') connected to one another by webs (22; 22'); and a refractory tube wall lining having a plurality of refractory tiles (1) which are arranged next to and above one another, at least one tile holder (11) to hold each tile (1) on the wall, said at least one tile holder (11) permitting displacement of said tile (1) parallel to said wall structure, and said plurality of refractory tiles (1) being supported by at least one bracket (3) which is independent of said at least one tile holder (11), wherein said at least one tile holder (11) and said at least one bracket (3) each attach to the webs (22; 22'), said refractory tube wall lining being positioned adjacent said wall structure to protect said wall structure from a source of heat applied to said refractory tube wall lining on a side thereof that is opposite said wall structure.

16. The fire-proof barrier according to claim 15, wherein there is a space between said wall structure and said refractory tube wall lining and said space is filled with liquid mortar, the liquid mortar preferably being an SiC liquid mortar with an SiC content of between 30% and 90% and a porosity of less than 20%.

17. The wall with a refractory lining according to claim 15, wherein there is a space between said wall structure and said refractory tube wall lining and said space is filled with liquid mortar, the liquid mortar preferably being an SiC liquid mortar with an SiC content of between 40% and 60%.

18. The wall with a refractory lining according to claim 15, wherein there is a space between said wall structure and said refractory tube wall lining and said space is filled with liquid mortar, the liquid mortar preferably being an SiC liquid mortar with a porosity between 13% and 17%.

* * * * *